US009647387B1

(12) United States Patent
Gou et al.

(10) Patent No.: US 9,647,387 B1
(45) Date of Patent: May 9, 2017

(54) ELECTRICAL CONNECTOR WITH GROUNDING TERMINAL

(71) Applicant: ALLTOP ELECTRONICS (SUZHOU) LTD., Taicang, JiangSu Province (CN)

(72) Inventors: Ya-Juan Gou, Taicang (CN); Zhi-Qiang Rong, Taicang (CN); Wang-I Yu, New Taipei (TW); Mao-Jung Huang, New Taipei (TW); Yi-Chang Chen, New Taipei (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/240,475

(22) Filed: Aug. 18, 2016

(30) Foreign Application Priority Data

Apr. 18, 2016 (CN) ..... 2016 1 02360053

(51) Int. Cl.

| | |
|---|---|
| ***H01R 13/627*** | (2006.01) |
| ***H01R 24/64*** | (2011.01) |
| ***H01R 13/6581*** | (2011.01) |
| *H01R 107/00* | (2006.01) |

(52) U.S. Cl.
CPC ..... *H01R 13/6273* (2013.01); *H01R 13/6581* (2013.01); *H01R 24/64* (2013.01); *H01R 2107/00* (2013.01)

(58) Field of Classification Search
CPC ..... H01R 13/6273; H01R 13/6581; H01R 24/64; H01R 2107/00
USPC ..... 439/108, 350, 357, 607.35–607.4
See application file for complete search history.

(56) References Cited

U.S. PATENT DOCUMENTS

| | | | | |
|---|---|---|---|---|
| 7,985,091 | B1 * | 7/2011 | Fu | H05K 5/0278 439/345 |
| 8,152,566 | B1 * | 4/2012 | Little | H01R 13/6582 439/607.41 |
| 9,525,227 | B2 * | 12/2016 | Little | H01R 13/6273 |
| 2014/0199879 | A1 * | 7/2014 | Rengifo | H01R 13/639 439/371 |
| 2016/0248190 | A1 * | 8/2016 | Matsuyama | H01R 13/6271 |

* cited by examiner

*Primary Examiner* — Khiem Nguyen
(74) *Attorney, Agent, or Firm* — Sughrue Mion, PLLC

(57) ABSTRACT

A connector includes a first contact module, a second contact module, a shielding shell and a latching member. The contact modules each include a number of contacts and an insulator retaining the contacts. The contact has a fastening portion assembled in the insulator, a contacting portion extending from the fastening portion, and a terminal portion extending from the fastening portion opposite to the contacting portion. The shielding shell covers around the first and the second contact modules. The latching member assists to secure the connection between the electrical connector with a complementary connector. The first contacts and the second contacts each have a pair of grounding terminals and the latching member connects with the pair of grounding terminals.

17 Claims, 9 Drawing Sheets

ELECTRICAL CONNECTOR WITH GROUNDING TERMINAL

BACKGROUND

1. Technical Field

The present disclosure relates to an electrical connector, and more particularly to an electrical connector with grounding terminals for mounting onto a printed circuit board.

2. Description of Related Art

The USB-IF announced USB Type-C™ standards in 2014. This kind of connector of USB Type-C™ features double-direction insertions. In the same time, the transmission rate and shielding performance are improved. This type of connector is secure to the complementary connector by a pair of latching arms of a central pad which complicate the production and the assembly of the connector.

Hence, there is a need to improve such kind of connector.

SUMMARY

The present disclosure includes an electrical connector includes a first contact module, a second contact module, a shielding shell and a latching member. The contact modules each include a number of contacts and an insulator retaining the contacts. The contact has a fastening portion assembled in the insulator, a contacting portion extending from the fastening portion, and a terminal portion extending from the fastening portion opposite to the contacting portion. The shielding shell covers around the first and the second contact modules. The latching member assists to secure the connection between the electrical connector with a complementary connector. The first contacts and the second contacts each have a pair of grounding terminals and the latching member connects with the pair of grounding terminals.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
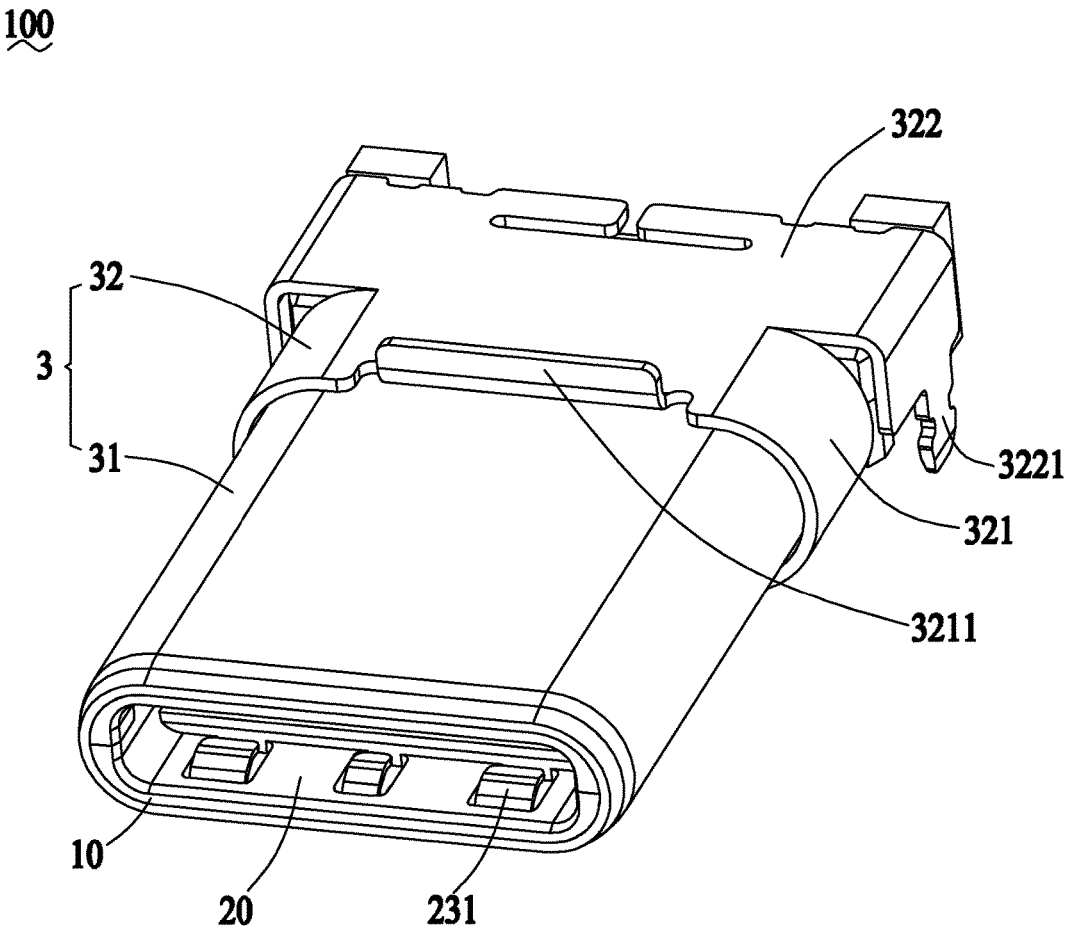
FIG. 1 is a perspective view of an electrical connector, complying to standard of USB 2.0 type C, in accordance with the present invention.

Reference will now be made to the drawing figures to describe the embodiments of the present disclosure in detail. In the following description, the same drawing reference numerals are used for the same elements in different drawings.

Referring to FIGS. 1 to 6, an illustrated embodiment of the present invention discloses an electrical connector 100 which complies to standard USB 2.0 Type-C™. The electrical connector 100 is employed to mounted onto a printed circuit board (not shown) and engages with a complementary connector (not shown). The electrical connector 100 includes contact modules 1, a shielding shell 3 covered around the contact modules 1 and a grounding module 2 assembled between the shielding shell 3 and the contact modules 1.

The contact modules 1 include a first contact module 4, a second contact module 5 and an insulative housing 6 for fixing the first and the second contact modules 4, 5 together. The first contact module 4 and the second contact module 5 are assembled along an upper-to-down direction, i.e. a thickness direction of the electrical connector 100. It should be noted here that the insulative housing 6 can be removed by other means which can also connect together the first and the second contact modules 4, 5. For example, such other means could be a block and a recess engageable with the block.

Figure 3:
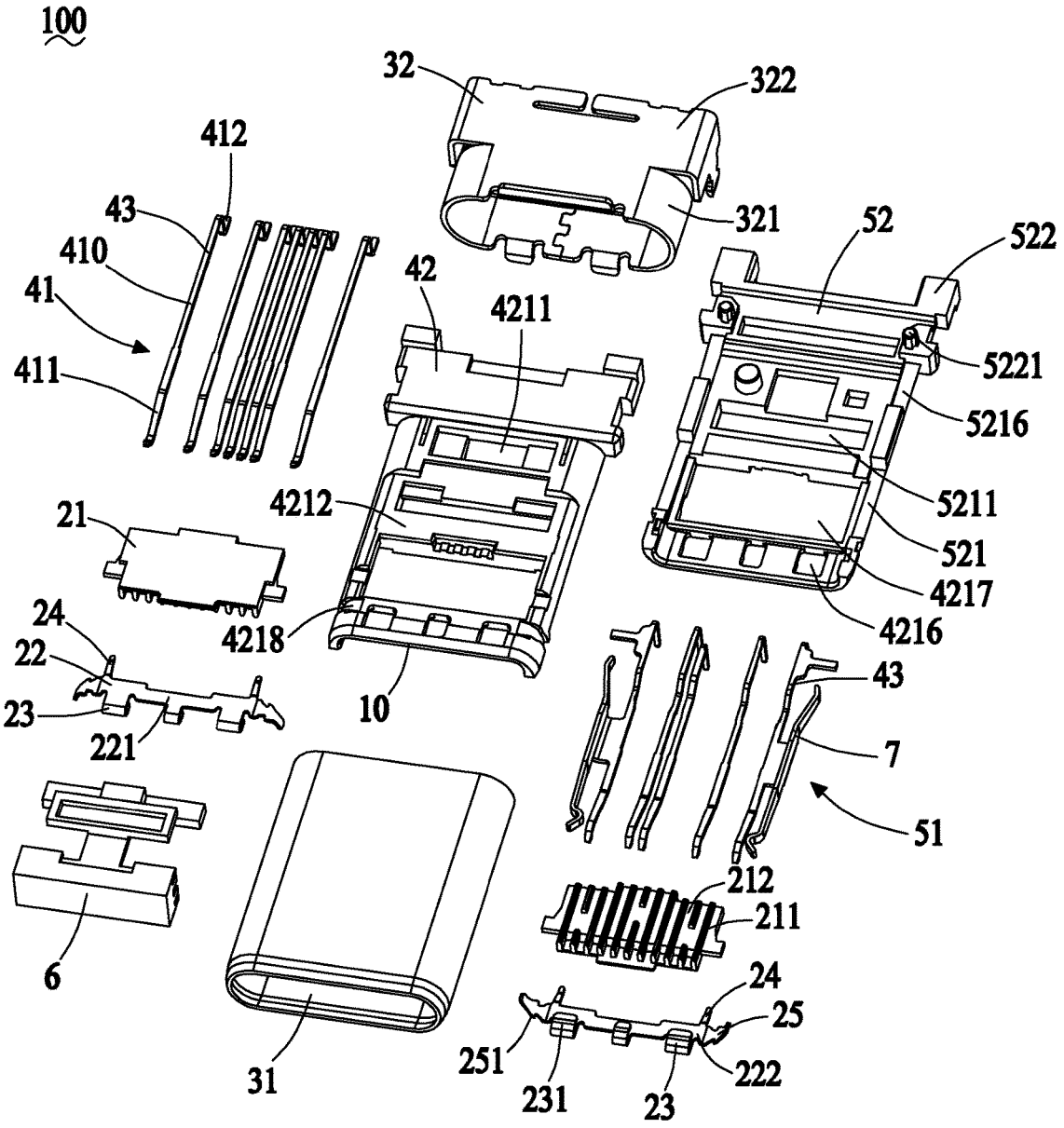
FIG. 3 is an exploded view of the electrical connector as shown in FIG. 1.
Figure 4:
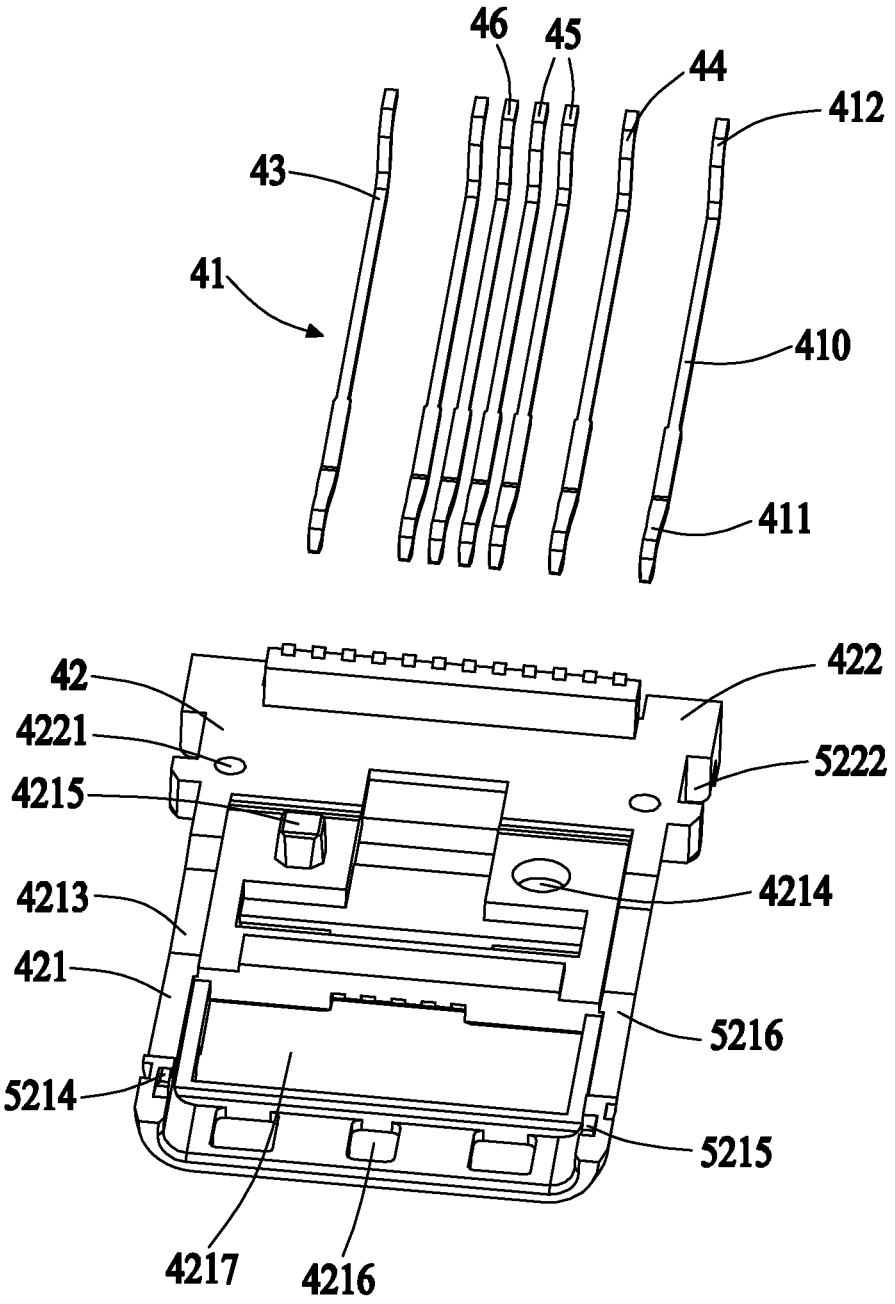
FIG. 4 is an exploded, perspective view of a first contact module as shown in FIG. 2.
Figure 5:
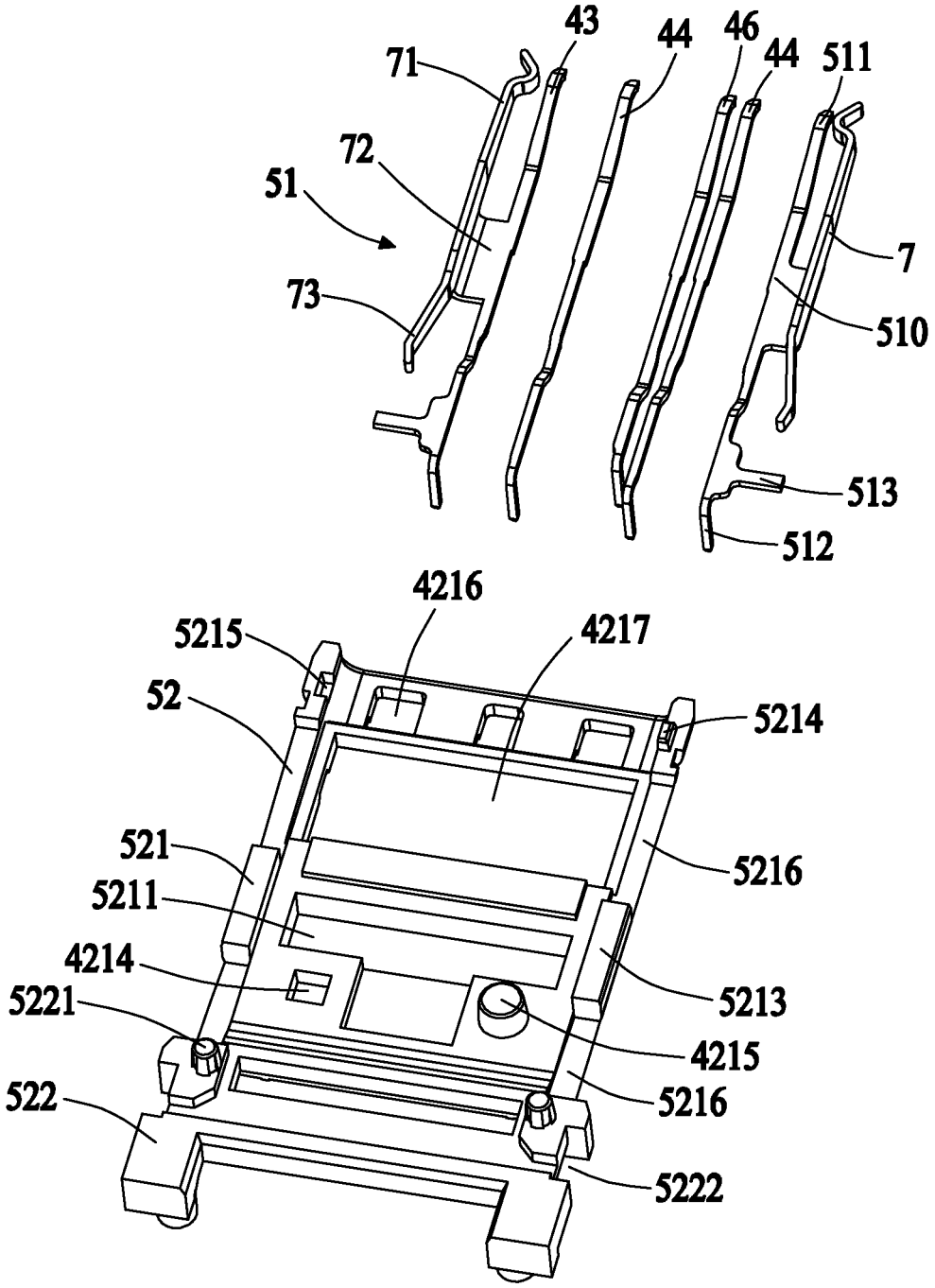
FIG. 5 is an exploded, perspective view of a second contact module as shown in FIG. 2.

Turning to FIGS. 4 and 5 with FIG. 3, the first contact module 4 has a plurality of first contacts 41 and a first insulator 42 securing the plurality of first contacts 41. The first contacts 41 each have a first fastening portion 410 assembled in the first insulator 42, a first contacting portion 411 extending from one end of the first fastening portion 410 and a first soldering terminal portion 412 extending from an opposite end of the first fastening portion 410. In this preferred embodiment, the first contacts 41 are arranged in one row and insert-molded within the first insulator 42. The first soldering terminal portion 412 extends downwards from the first fastening portion 410 and towards the printed circuit board along a horizontal direction to thereby soldered thereto. The first soldering terminal portions 412 are transversally positioned in one row.

The second contact module 5 has a plurality of second contacts 5 and a second insulator 52 securing the second plurality of second contacts 5. The second contacts 51 each have a second fastening portion 510 assembled in the second insulator 52, a second contacting portion 511 extending from one end of the second fastening portion 510 and a second soldering terminal portion 512 extending from an opposite end of the second fastening portion 510. In this preferred embodiment, the second contacts 51 are arranged in one row and insert-molded within the second insulator 52. The second soldering terminal portion 512 extends downwards from the second fastening portion 510 and towards the printed circuit board. The second soldering terminal portions 512 are arranged in two rows along a front-to-back direction and staggered positioned with each other.

The first contacts 41 and the second contacts 51 each comprise two grounding terminals 43, two power contacts 44 next to the two grounding terminals 43, and a differential pair 45 and a detecting contact 46 positioned between the two power contacts 44. Such an arrangement of the first contacts 41 and the second contacts 51 are meeting with the standard connector of USB 2.0 Type-C™.

The first insulator 42 comprises a first tongue section 421 and a first assembling section 422 connecting with the first tongue section 421. The dimensions of the first tongue section 421 is smaller than the dimensions of the first assembling section 422 either from an upper-to-down direction or a left-to-right direction. A first recess 4211 is defined between an intersection of the first tongue section 421 and the first assembling section 422. The first recess 4211 extends throughout the first insulator 42 to correspondingly position the first contacts 41. The first tongue section 421 forms an outer surface 4212 confronting the shielding shell 3 and an inner surface 4213 confronting the second insulator 52. A positioning hole 4214 is recessed from the inner surface 4213 and a positioning post 4215 is formed oppositely. A pair of engaging grooves 4221 are recessed from an inside wall of the first assembling section 422 towards the second insulator 52.

The second insulator 52 includes a second tongue section 521 and a second assembling section 522 connecting with the second tongue section 521. The dimensions of the second tongue section 521 is smaller than the dimensions of the second assembling section 522 either from an upper-to-down direction or a left-to-right direction. An engaging space 20 is defined by forward ends of the first and the second tongue sections 421, 521 to thereby receiving the contacting portions 411, 511. A pair of engaging cutouts 5215 are respectively formed in the forward ends of the first tongue section 421 and the second tongue section 521. Correspondingly, a pair of engaging blocks 5214 which can be blocked in corresponding engaging cutouts 5215, are formed respectively in the forward ends of the first tongue section 421 and the second tongue section 521. A pair of engaging posts 5221 are formed on the second assembling section 522 for engaging with the pair of engaging grooves 4221 of the first assembling section 422.

Similarly, the second tongue section 521 defines an outer face confronting the shielding shell 3 and an inner face 5213 confronting the first insulator 42. A second recess 5211 is also recessed from the inner face 5213. The first contact module 4 and the second contact module 5 are fixedly assembled together by the engagements between the positioning posts 4215 with the positioning holes 4214, the engaging cutouts 5215 with the engaging blocks 5214, and the engaging posts 5221 with the engaging grooves 4221. It can be understood that the shapes and the configurations of the above-described engageable members are changeable according to different requirements. The grounding terminal 43 of the second contact 51 provides a horizontal extending, beam 513 at a distal rear end thereof. Correspondingly, a slot 5222 is defined on side edge of the first assembling section 422 and the second assembling section 522 for mating with the beam 513.

The electrical connector 100 also comprises a latching member 7 which is connecting to the grounding terminals 43 of the first contacts 41 or the second contacts 51. The latching member 7 is employed to secure the connection between the electrical connector 100 and the complementary connector. The latching member 7 is located besides the first contacting portion 411 and the second contacting portion 511. In this preferred embodiment, there are two of such latching member 7 and the latching members 7 extend from the grounding terminals 43 of the second contacts 51. As can be understood, in other embodiments, the latching members 7 can be designed to extend from the grounding terminals 43 of the first contacts 41. The latching member 7 has a resilient latching arm 71 adjacent to the first contacting portion 411 and the second contacting portion 511, an L-shaped retaining portion 72 connecting the resilient latching arm 71 with the grounding terminal 43, and a resilient resisting arm 73 adjacent to the first retaining portion 410 and the second retaining portion 510. The resilient resisting arm 73 and the resilient latching arm 71 each have a curved end which are protruded along opposite directions. In this preferred embodiment, the L-shaped retaining portion 72 is insert-molded within the second tongue section 521. The first tongue section 421 and the second tongue section 521 provide receiving cutouts 5216 on lateral edges thereof for receiving the resilient latching arm 71 and the resilient resisting arm 73. In other words, when the first tongue section 421 and the second tongue section 521 are assembled together, the resilient latching arm 71 and the resilient resisting arm 73 are exposed within the receiving cutouts 5216. The forward curved end of the resilient latching arm 71 extends into the engaging space 20 from the receiving cutout 5216 to thereby contact with the complementary connector. The curved end of the resilient resisting arm 73 extends beyond the receiving cutout 5216 for contacting with the shielding shell 3.

Referring to FIGS. 2 to 5, the grounding module 2 has a pair of grounding members assembled onto the first contact module 4 and the second contact module 5 and sandwiched between the contact modules with the shielding shell 3. The grounding member 2 includes a spacer 21 and a grounding pad 22 assembled to the spacer 21. The grounding member 2 are positioned adjacent to a front end of the electrical connector 100 for electrically connecting to the complementary connector for grounding purposes. The spacer 21 provides a plurality of protrusions 211 confronting the first contacts 41 and the second contacts 51, respectively. An elongated slot 212 is defined by two neighbored protrusions 211 and extends along the front-to-back direction. The elongated slots 212 are configured to receive and limit the movement of the first contacting portion 411 and the second contacting portion 511. In the preferred embodiment, the spacer 21 is provided for insulatively isolating the first, the second contacts 41, 51 with the shielding shell 3 to avoid undesired short therebetween. The grounding pad 22 includes an upper grounding pad 221 assembled on the first insulator 42 and a lower grounding pad 222 assembled on the second insulator 52. In this preferred embodiment, the upper grounding pad 221 and the outer surface 4212 are in the same plane and the lower grounding pad 222 and the outer face 5212 are in the other same plane. The grounding pad 22 provides an inner tab 23 and an outer tab 24. A U-shaped head 231 is formed at a distal forward end of the inner tab 23. In a thickness direction of the electrical connector, it looks that the U-shaped head 231 is located between the first contacting portion 411, the second contacting portion 511 and a front face 10 of the electrical connector 100. The outer tab 24 extends backwards along the longitudinal direction of the electrical connector 100 and contacts to the shielding shell 3 to thereby achieve an electrical connection therebetween.

A plurality of receiving holes 4216 and a receiving room 4217 are defined at a front side of both the first tongue section 421 and the second tongue section 521. The receiving holes 4216 are configured for engaging with the U-shaped head 231 and the receiving room 4217 is configured for receiving the spacer 21. The first contacting portions 411 and the second contacting portions 511 are exposed at the receiving room 4217 and limited within the elongated slots 212. The grounding pad 22 has fixing tabs 25 at opposite sides thereof. A fixing hole 4218 is defined respectively at the first tongue section 421 and the second tongue section 521 for receiving corresponding fixing tab 25 with barbs 251 thereon to thereby secure the grounding pad 22 in the first and the second insulators 42, 52.

Figure 6:
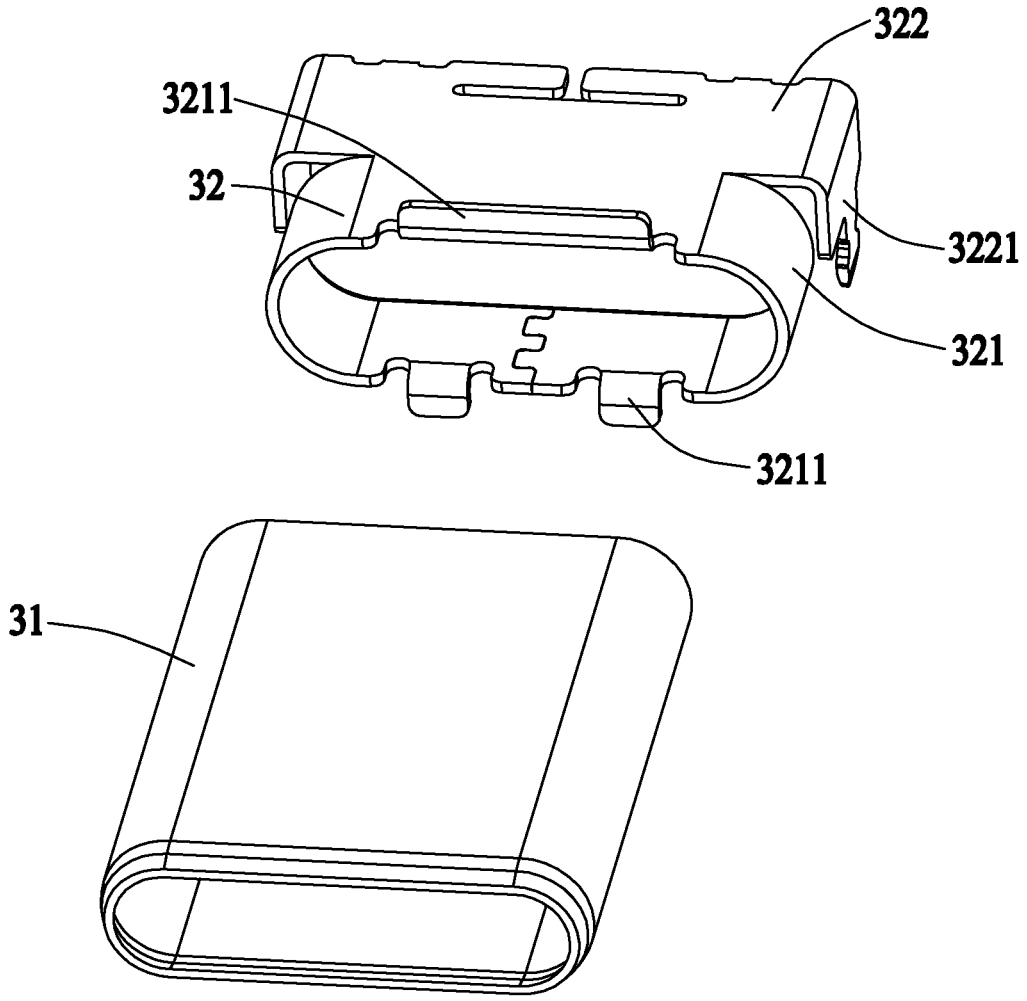
FIG. 6 is an exploded, perspective view of a shielding shell as shown in FIG. 2.

Referring to FIG. 6, the shielding shell 3 includes an inner shell 31 covering the first and the second contact modules 4, 5 and an outer shell 32 partially overlapped with the inner shell 31. In details, the inner shell 31 covers totally around the forward ends of the first and the second contact modules 4, 5. The outer shell 32 covers the rear ends of the first and the second contact modules 4, 5. In other words, the inner shell 31 encloses the first tongue section 421, the second tongue section 521 and the grounding members 2. The resilient resisting arm 73 electrically and mechanically contacts with inside face of the inner shell 31. The outer shell 32 includes a first shielding section 321 assembled to a rear side of the inner shell 31 and a second shielding section 322 enclosing the first assembling section 422 and the second assembling section 522. The first shielding section 321 forms a plurality of front erecting edges 3211 at opposite upper and lower sides thereof to reinforce the whole strength during insert-molding. A pair of solder tails 3221 are provided at respective opposite sides of the second shielding section 322 to soldering the outer shell 32 to the printed circuit board. The shape of the outer shell 32 is substantially identical to the shape of the inner shell 31 to thereby facilitate soldering between these two shells 31, 32.

Figure 2:
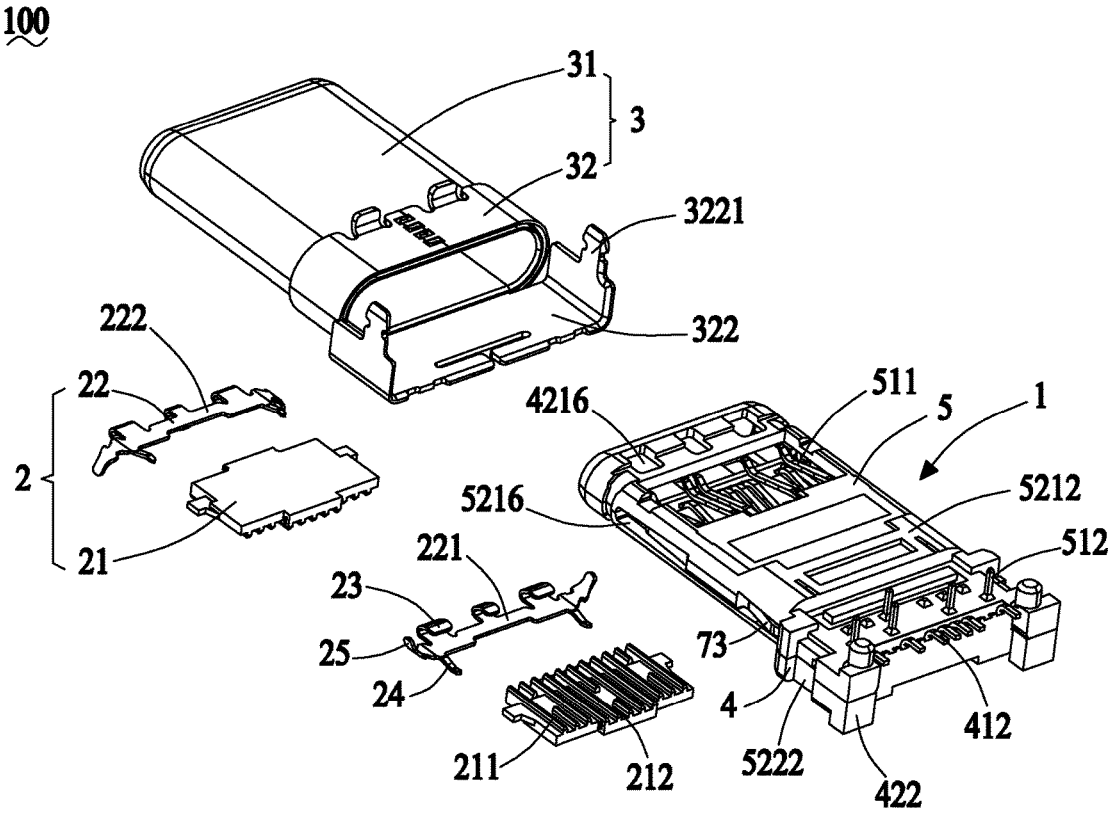
FIG. 2 is partially exploded, perspective view of the electrical connector as shown in FIG. 1.
Figure 7:
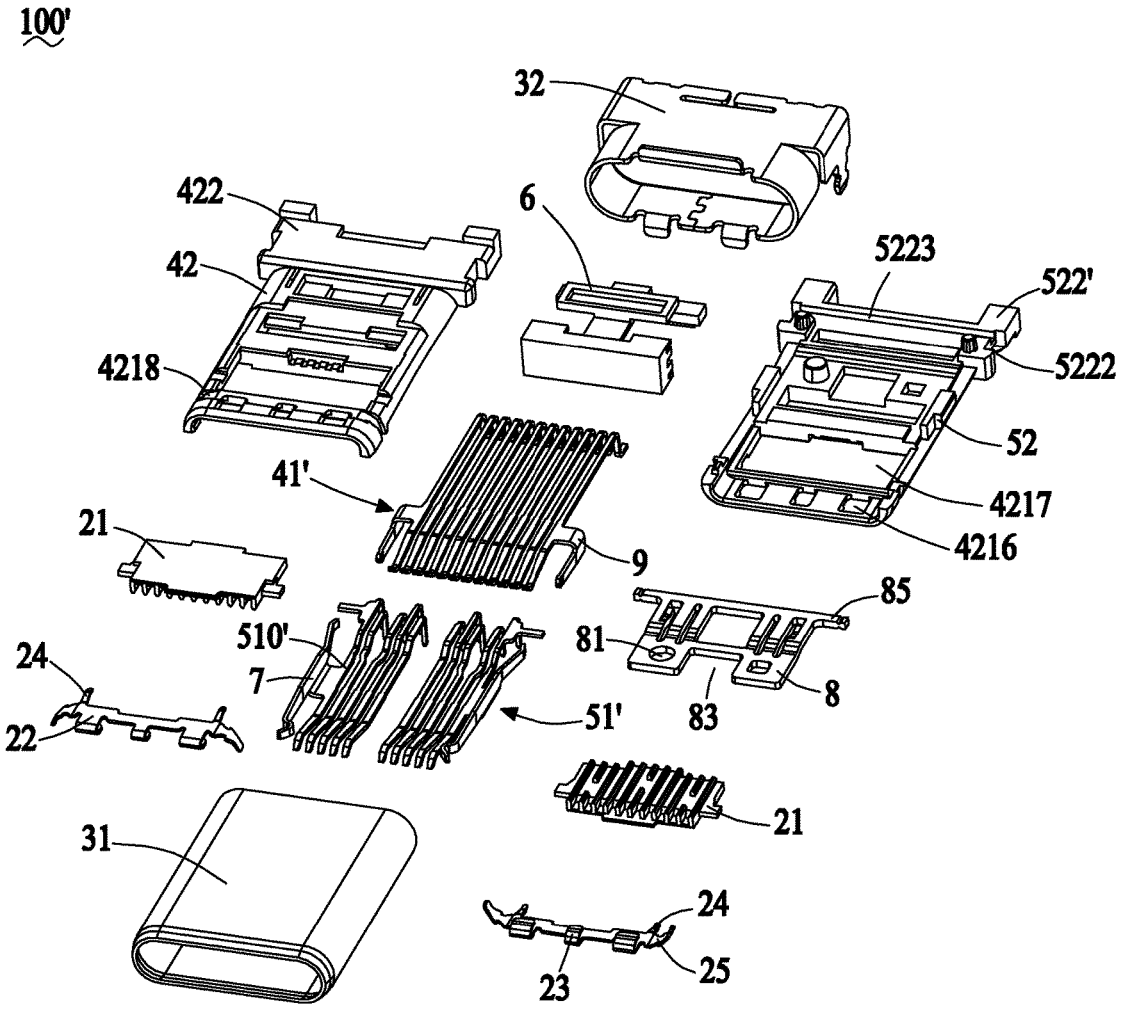
FIG. 7 is an exploded, perspective view of the electrical connector complying to standard of USB 3.1 type C, in accordance with the other embodiment of the present invention.
Figure 8:
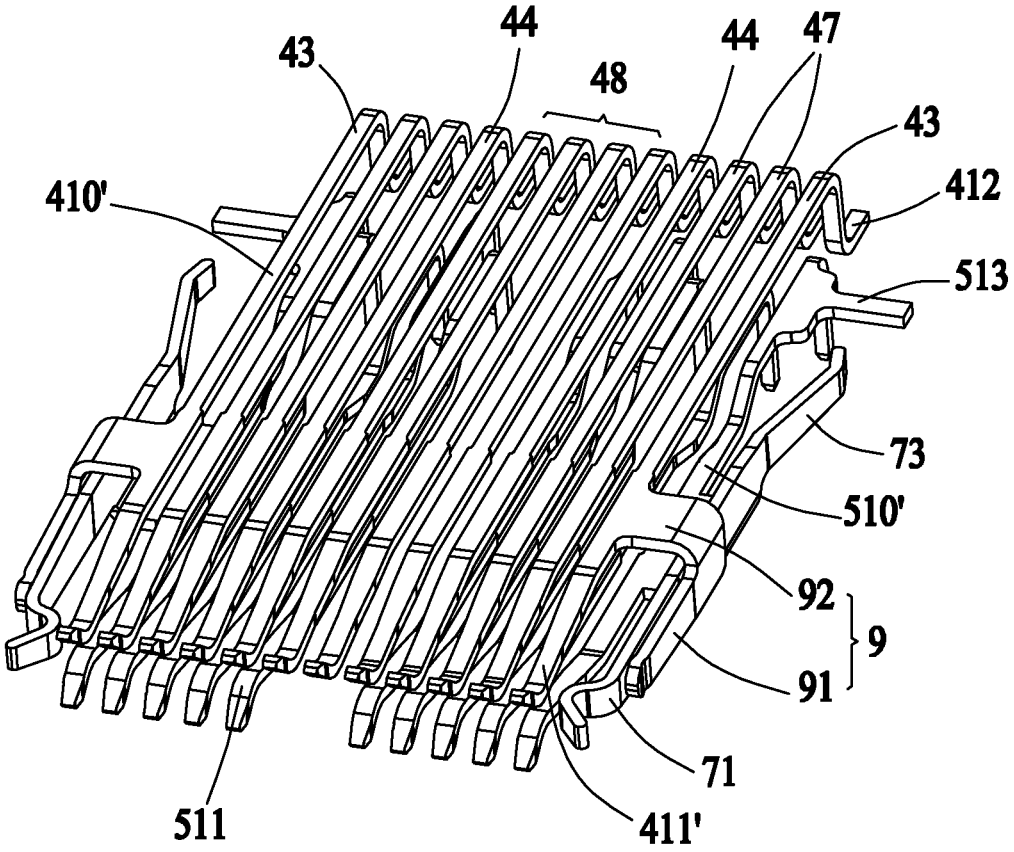
FIG. 8 is a perspective view showing engagement between first contacts and second contacts shown in FIG. 7.
Figure 9:
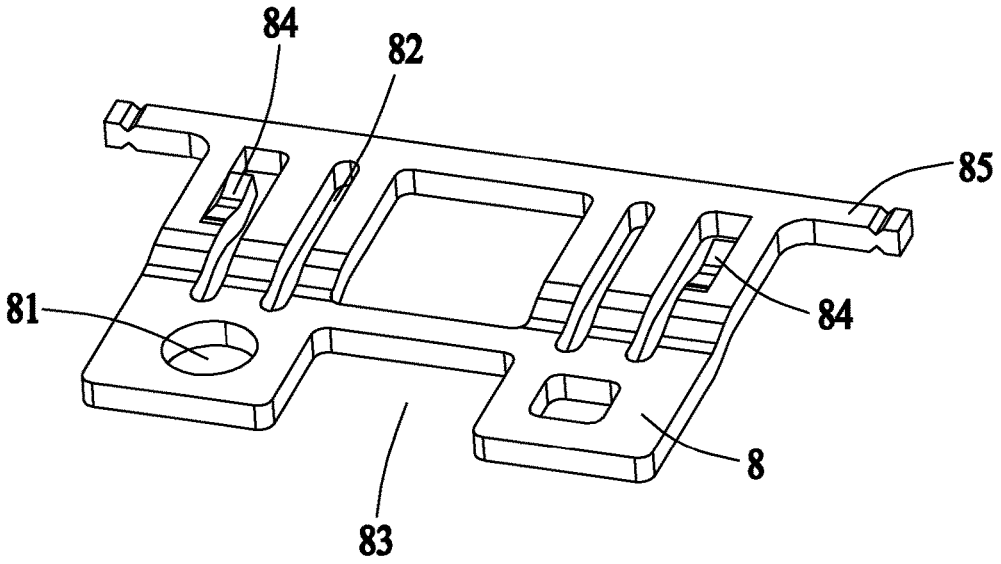
FIG. 9 is a perspective view of a central grounding pad shown in FIG. 7.

Referring to FIGS. 7 to 9 together with FIGS. 2 and 3, the other embodiment, of which the electrical connector complies with the standard USB 3.1 Type-C™, is shown. The structures of the two embodiments are similar. The main differences are in the arrangement of the contacts and the electrical connector 100' further includes a central grounding pad 8 and the limiting means 9. Hereinafter, the details of the differences will be introduced one by one.

In this embodiment, the first contacts 41' have a pair of grounding terminals 43, two differential pairs 47 next to the grounding terminals 43, two power contacts 44 neighbored to the differential pairs 47, and four signal contacts 48 between the two power contacts 44. The second contacts 51' have a pair of grounding terminals 43, two differential pairs 47 next to the grounding terminals 43, two power contacts 44 neighbored to the differential pairs 47, and two signal contacts 48 between the two power contacts 44. Such an arrangement of the contacts 41', 51' comply with the standard USB 3.1Type-C™. Compared to the electrical connector 100 with the first embodiment, the electrical connector 100' also provides a central grounding pad 8 fixed between the first contact module 4 and the second contact module 5. The central grounding pad 8 is configured to cover rear side of the first insulator 42 and the second insulator 52 to thereby perform shielding purpose. The central grounding pad 8 defines a pair of positioning holes 81 to cooperate with the positioning posts 4215, a pair of elongated slits 82 and the rectangular slits 83. The first recess 4211, the second recess 5211 and the rectangular slit 83 are communicating with each other in order to secure together the first contact module 4, the second contact module 5 and the central grounding pad 8 by insert-molding the insulative housing 6 therein.

The central grounding pad 8 overlaps the first fastening portion 410' and the second fastening portion 510' and forms a plurality of contacting arms 84 communicating with the grounding terminals 43. In the embodiment, the contacting arms 84 are provided in corresponding slots 82 and protruded to the second contacts 51' to thereby contact with the grounding terminal 43 of the second contacts 51'. As can be understood, in other embodiment, the contacting arms 84 could be also located at opposite sides of the central grounding pad 8 and positioned between the two resilient resisting arms 73. The inside face of the inner shell 31 will contact to the resilient resisting arm 73 and makes the resilient resisting arm 73 move closely to the first contacts 41', the second contacts 51, when the inner shell 31 is assembled to the contact module 1. Therefore, an electrical connection is established between the resilient resisting arms 73 and the contacting arms 84. The central grounding pad 8 defines a pair of horizontal, oppositely extended sections 85 from a back end thereof. The horizontal, oppositely extended sections 85 each have a distal end protrude beyond the second assembling section 522' from the slot 5222 to thereby electrically connect to the shielding shell 3. The second assembling section 522' defines a restriction recess 5223 recessed therefrom for receiving the horizontal, extended sections 85. The restriction recess 5223 and the slot 5222 are communicate with each other.

The limiting means 9 of the connector 100' of this second embodiment, is integrally formed with the grounding terminal 43 of the first contacts 41', and the latching member 7 is integrally formed with the grounding terminal 43 of the second contact 51'. It should be noted here that, in other embodiment, the limiting means 9 can be formed integrally with the grounding terminal 43 of the second contact 51' and the latching member 7 is formed integrally with the grounding terminal 43 of the first contact 41'. The limiting means 9 and the latching member 7 are oppositely positioned with the resilient latching arms 71 environed correspondingly by the limiting arms 91. The limiting arm 91 extends substantially parallel to the resilient latching arm 71 and locates at a plane substantially perpendicular to the grounding terminal 43. The limiting means 9 also includes an L-shaped connecting arm 92 connecting the limiting arm 91 with the grounding terminal 43. The L-shaped connecting arm 92 is insert-molded in the first insulator 42. The limiting arm 91 is located outside of the latching arm 71 and exposed to the receiving cutout 5216. During the engagement between the electrical connector 100' and the complementary connector, the limiting arm 91 can limit an undesired outward movement of the latching arm 71.

In this embodiment, the limiting means 9 is only positioned at the side of the first contacting portion 411'. While in other embodiment, the limiting means 9 can also positioned at the side of the first fastening portion 410' with the limiting arm 91 overlapping and located inside of the resilient resisting arm 73. When the resilient resisting arm 73 contacts with the inner shell 31, the limiting means 9 stops the further undesired movement of the resilient resisting arm 73 to thereby protecting the resilient resisting arm 73 from deformation. It should be noted that the limiting means 9 can be employed in not only the USB 3.0 type C connector (as shown in FIGS. 7 and 8), but also the USB 2.0 type C connector (as shown in FIGS. 2 and 3).

The latching member 7 of the electrical connector 100, 100', connecting with the grounding terminal 43 and positioned by the first contacting portion 411, 411' and the second contacting portion 511, provides a reliable connection between the electrical connector and the complementary connector. The central grounding pad 8 is only positioned at the rear part of the connector to performance shielding and the impedance matching. As can be readily understood, the grounding module 2, the grounding members and/or the central grounding pad can be deemed as a grounding means used in the connector. Subsequently, the structure and the assembly of the whole connector are simplified.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector for electrically connecting with a complementary connector, comprising:

a first contact module including a plurality of first contacts and a first insulator retaining said first contacts, each of said plurality of first contacts comprising a first fastening portion assembled in said first insulator, a first contacting portion extending from said first fastening portion, and a first soldering terminal portion extending from said first fastening portion opposite to said first contacting portion;

a second contact module including a plurality of second contacts and a second insulator retaining said second contacts, each of said plurality of second contacts comprising a second fastening portion assembled in said second insulator, a second contacting portion extending from said second fastening portion, and a second soldering terminal portion extending from said second fastening portion opposite to said second contacting portion;

a shielding shell covered around said first and said second contact modules; and a latching member assisting to secure the connection between said electrical connector with said complementary connector;

wherein said first contacts and said second contacts each have a pair of grounding terminals; and wherein said latching member connects with said pair of grounding terminals of said first contact module or said second contact module.

2. The electrical connector as claimed in claim 1, wherein said grounding member is located adjacent to said contacting portions.

3. The electrical connector as claimed in claim 1, wherein said latching member comprises a resilient latching arm extending along a same direction with said contacting portion for latching with said complementary connector, and a resilient resisting arm extending oppositely to said resilient latching arm.

4. The electrical connector as claimed in claim 3, wherein said resilient latching arm of said latching member extends along a plane substantially, perpendicularly to a plane of said contacting portion.

5. The electrical connector as claimed in claim 3, wherein said resilient resisting arm and said resilient latching arm each have a curved end while said curved ends of said resilient resisting arm and said resilient latching arm are curved oppositely to each other.

6. The electrical connector as claimed in claim 3, wherein said latching member also has an L-shaped retaining portion connecting to said grounding terminal.

7. The electrical connector as claimed in claim 5, wherein said shielding shell includes an inner shell covering said first and said second contact modules, and an outer shell partially overlapped with said inner shell.

8. The electrical connector as claimed in claim 7, wherein said resilient resisting arm is configured beyond said first or said second insulator and to electrically connect with said inner shell of said shielding shell.

9. The electrical connector as claimed in claim 3, wherein said latching member is located between said first contacts and said second contacts in a thickness direction view of said electrical connector.

10. The electrical connector as claimed in claim 3, further comprising a limiting member positioned for limiting undesired outwards movement of said latching member.

11. The electrical connector as claimed in claim 10, wherein said limiting member and said latching member connect with different grounding terminals and wherein said limiting member has a limiting arm overlapped with and located outside of said resilient latching arm.

12. The electrical connector as claimed in claim 1, further comprising a grounding means for electrically connecting to said grounding terminals and/or said shielding shell.

13. The electrical connector as claimed in claim 12, wherein said grounding means has a pair of grounding members assembled onto said first contact module and said second contact module, respectively.

14. The electrical connector as claimed in claim 13, wherein said pair of grounding members each includes a spacer and a grounding pad insert-molded within said spacer, and wherein said grounding pad comprises an inner tab located adjacent to forward end of said electrical connector for electrically connecting with said complementary connector, and an outer tab extending opposite to said inner tab and electrically connecting with said shielding shell.

15. The electrical connector as claimed in claim 12, wherein said grounding means has a central grounding pad assembled between said first insulator and said second insulator, and wherein said central grounding pad has contacting arm connecting with said grounding terminal.

16. The electrical connector as claimed in claim 1, wherein said plurality of first contacts and said plurality of second contacts each have two of said grounding terminals, a pair of power contacts next to corresponding grounding terminals, and a differential pair and a detecting contact between said pair of power contacts.

17. The electrical connector as claimed in claim 1, wherein said plurality of first contacts and said plurality of second contacts have four differential pairs.

* * * * *